United States Patent [19]

Lynch

[11] Patent Number: 4,797,206

[45] Date of Patent: Jan. 10, 1989

[54] SIPHON DEVICE FOR CLEANING SPAS

[76] Inventor: James P. Lynch, 6901 W. 87th Way, #304, Arvada, Colo. 80003

[21] Appl. No.: 795,362

[22] Filed: Nov. 6, 1985

[51] Int. Cl.[4] ..... E04H 3/20; F04F 10/02

[52] U.S. Cl. ..... 210/169; 210/416.2; 15/1.7; 15/415 A

[58] Field of Search ..... 210/169, 416.1, 416.2; 15/1.7, 415 A, 415 R, 410, 420, 421

[56] References Cited

U.S. PATENT DOCUMENTS

| | | | |
|---|---|---|---|
| 2,820,548 | 1/1958 | Marcus et al. | 210/416.2 |
| 2,823,410 | 2/1958 | Aleo | 15/420 |
| 3,243,830 | 4/1966 | Conrad | 15/420 |
| 3,245,420 | 4/1966 | Cherney | 15/1.7 |
| 3,348,686 | 10/1967 | Spitzer | 210/416.2 |
| 3,630,364 | 12/1971 | Johnston | 15/1.7 |
| 3,734,853 | 5/1973 | Horvath | 210/169 |
| 4,208,752 | 6/1980 | Hofmann | 15/1.7 |
| 4,443,899 | 4/1984 | Johnson | 15/1.7 |
| 4,584,733 | 4/1986 | Tietge et al. | 15/1.7 |

FOREIGN PATENT DOCUMENTS

| | | | |
|---|---|---|---|
| 1248896 | 8/1967 | Fed. Rep. of Germany | 15/420 |

*Primary Examiner*—Richard V. Fisher
*Assistant Examiner*—Linda Evans
*Attorney, Agent, or Firm*—Timothy J. Martin; J. Preston Oxenham

[57] ABSTRACT

A cleaning device for cleaning spas by removing particulate debris siphons liquids from the spa so that the debris is sucked out of the spa by the fluid flow. The device includes a rigid handle portion, an upstream nozzle and a downstream hose having a discharge outlet to define a fluid passageway. Preferably, the nozzle and hose are formed of a continuous piece of thermoplastic tubing having an upstream end molded into the nozzle configuration, and the handle is a rigid thermoplastic tube telescopically receiving a portion of the hose adjacent the nozzle. A protector sleeve retards mechanical fatigue of the hose at the downstream edge of the handle. Preferably the nozzle has an ovoid inlet both canted at an acute angle to the handle's longitudinal axis and formed contiguously with an imaginary concave surface so that the inlet describes an arch when placed on a flat surface.

13 Claims, 2 Drawing Sheets

SIPHON DEVICE FOR CLEANING SPAS

BACKGROUND OF THE INVENTION

The present invention relates to a siphon device which may be used for removing particulate debris or other unwanted materials from the bottom surface of pools, such as spas, elevated swimming pools, whirlpools, Jacuzzis, hot tubs and the like. Thus, it should be appreciated that the word "spa" as used herein broadly encompasses these aquatic structures. Furthermore, while the present invention is described with respect to the cleaning of spas, it should be appreciated that it may be used to clean any other large, fluid containing vessel, without the need to remove all the fluid from the vessel.

Recently, the ownership and use of spas has widely increased due in part to their ability to provide pleasurable leisure time relaxation even, due in part, to the beneficial effects realized from their therapeutic use. Whether enjoyed in family use, as a social event, or for therapeutic reasons, a common problem with these spas is the need to periodically remove particulate debris which collects in the spas as a result of the ingress and egress of persons. This debris is usually in the form of sand, small stones, pebbles and the like, and, even though these spas typically contain large volumes of heated water, it is the common practice to drain the spa in order to remove this debris. Not only is the draining and refilling of these spas a time consuming task but also has two additional disadvantages. First, discharge of the water from the spa is exceedingly wasteful of water resources. Second, the heat content of the water is lost upon its drainage so that additional energy is required to heat newly added water to the spa, thus resulting in energy inefficiency.

Accordingly, there is a need for a more efficient technique for removing particulate debris from a spa. It is desirable that this technique permit the quick and thorough cleaning of the spa while at the same time avoiding the discharge of unnecessary water or fluid therefrom. There is thus need for a simple, yet effective tool that avoids the necessity of draining the spa to remove such particulate debris. The present invention is directed to the provision of such a tool.

SUMMARY OF THE INVENTION

It is an object of the present invention to provide a novel and useful device for cleaning spas and the like, which device is inexpensive to produce and easy to use.

It is another object of the present invention to provide a cleaning device for spas that operates on a siphoning principle and that is designed to generate a suitable pressure head for removing sand, small stones and the like from the bottom surface of a fluid container, such as a spa.

It is yet another object of the present invention to provide a simple, siphon device for cleaning spas which device is constructed to provide manufacturing advantages so as to reduce the cost of manufacture.

It is a still further object of the present invention to provide a cleaning device for spas which requires only a minimal amount of discharge of fluid therefrom.

To accomplish these objects, the present invention broadly includes an elongated relatively rigid tubular handle through which fluid is conveyed from an upstream end to a downstream end. A nozzle is connected to the upstream end of the handle and fluid communication therewith so that it may receive fluid from the spa which fluid thereafter flows through the nozzle and the handle. An elongated flexible hose is secured to the downstream end of the handle so that it may receive water discharge therefrom to convey the water to a waste location. Thus, the nozzle, handle and hose define a continuous passageway that may be filled with fluid, then, while the nozzle is maintained beneath the surface of the fluid in the spa, the discharge end of the hose is positioned at a lower gravitational position. A pressure head is thus developed, and fluid is siphoned out of the spa. The nozzle, handle and hose are designed to develop a sufficient pressure head so that sand, pebbles and other particulate debris may be sucked out of the spa by the siphoning action of the fluid and discharged at the waste location.

To achieve manufacturing advantages, the nozzle is preferably formed out of a pliable upstream end of the hose with this upstream end portion being deformed into the preferred shape of the nozzle. The tubular handle telescopically receives the portion of the hose just downstream of the nozzle so that the passageway through the tubular handle is provided by the hose portion therein. A protecting sleeve surrounds the downstream end of the rigid handle and helps prevent mechanical fatigue of the hose at the point where it exits from the handle at the downstream end.

Preferably, the upstream end of the nozzle terminates in a nozzle inlet or mouth formed by a continuous rim with this rim being canted at an acute angle to the longitudinal axis of the handle. Further, it is preferred that the inlet have a slight concavity so that it is formed on an imaginary concave surface with respect to the nozzle. Thus, the nozzle does not damage the finished surface of the spa bottom or side-wall yet at the same time does not vacuum-adhere to the bottom due to the concavity of the inlet.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a siphon device adapted to remove particulate debris from a spa by utilizing siphon fluid to convey the debris out of the spa as the fluid flows towards a waste location. While the present invention is described with respect to the cleaning of a spa, such as a pool, whirlpool, hot tub, Jacuzzis or the like, it should be understood that the present invention could be used with respect to the cleaning of any fluid container wherein some of the fluid could be discharged from the container during the cleaning process by a siphon device. Thus, the invention may have industrial applications in addition to those for the recreational and therapeutic industries.

Figure 1:
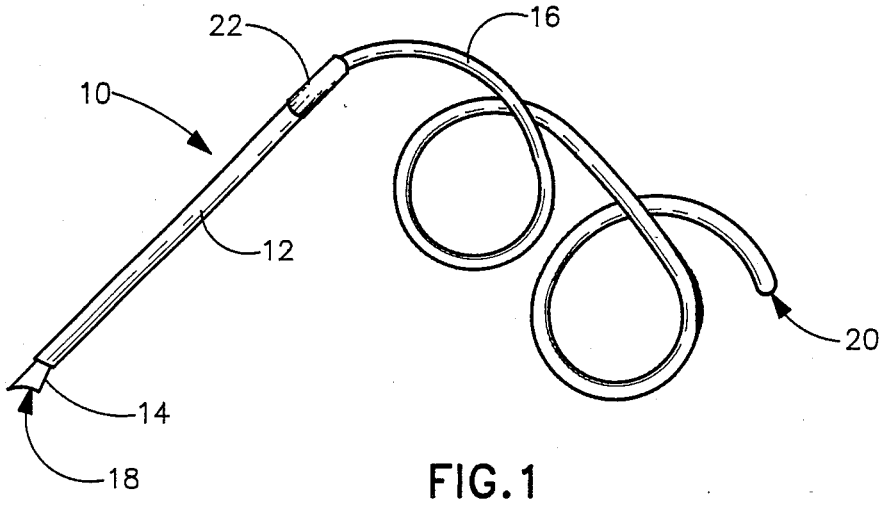
FIG. 1 is a perspective view of the siphon device according to the preferred embodiment of the present invention.

As is shown in FIG. 1, siphon device 10 includes an elongated, relatively rigid tubular handle 12, a nozzle 14 located upstream of the handle 12 and an elongated flexible hose 16 located downstream of handle 12. Nozzle 14, handle 12 and hose 16 form a flow passage for fluid from an extreme upstream inlet 18 on nozzle 14 to a discharge outlet 20 located at an extreme downstream end of hose 16. A protector sleeve 22 surrounds a downstream portion of handle 12 and a portion of hose 16 at the downstream end of handle 12 and is operated to reduce mechanical fatigue of the hose about the handle.

Figure 2:
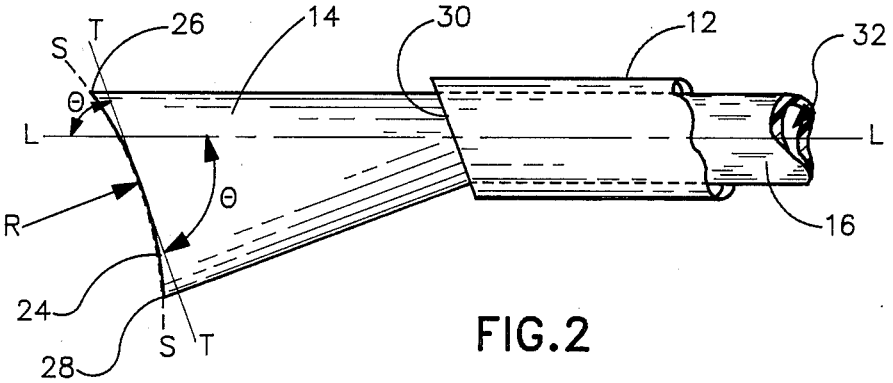
FIG. 2 is a side view in elevation of the upstream end of the siphon device shown in FIG. 1 and showing the nozzle structure at said upstream end.

FIGS. 2–5 best show the upstream end of siphon device 10, and in particular they show the nozzle structure constructed according to the preferred embodiment of the present invention. Specifically, nozzle 14 has a generally ovoid shaped rim 24 that has first and second extrema 26 and 28. As is shown in FIG. 2, rim 24 is contiguous with an imaginary concave surface S, which is preferably an imaginary spherical surface having a radius R so that surface S is concave with respect to nozzle 14. Radius R is selected to be four to eight times the arc segment distance between extrema 26 and 28, with this ratio preferably being 6:1. Further, the tangent line T of surface S at longitudinal axis L of handle 12 is canted at a large acute angle with respect to longitudinal axis L. Preferably, this angle $\theta$ is within a range of 60° to 80°, and is preferred to be approximately 70°. Thus, inlet 18 may be said to be canted at an angle of approximately 70° with respect to the longitudinal axis of the handle. Handle 12 has an upstream end 30 that is formed in a plane that is canted at a similar acute angle to axis L as is tangent line T and thus is generally parallel to this tangent line. Handle 12 has a longitudinal passageway 32 therethrough which is defined, in the preferred embodiment, by a portion of hose 16.

Figure 3:
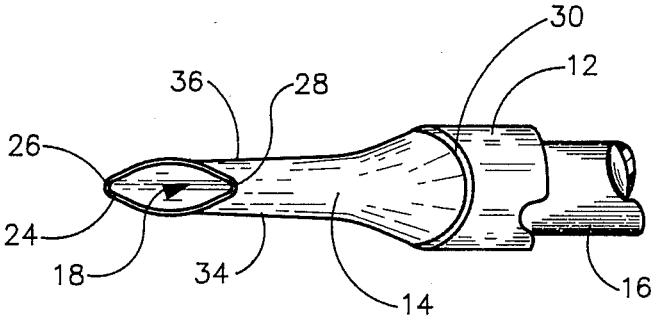
FIG. 3 is a bottom plan view of the nozzle structure shown in FIG. 2.
Figure 4:
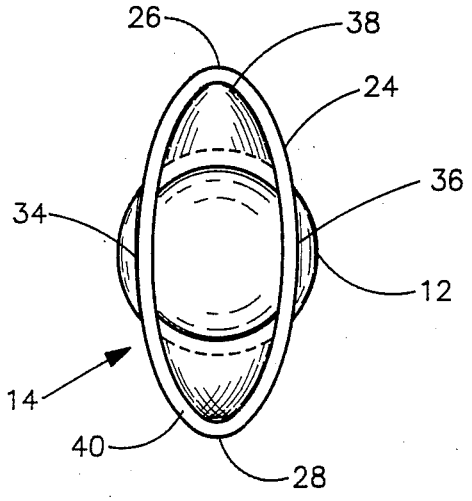
FIG. 4 is an end view in elevation of a nozzle structure shown in FIGS. 2 and 3.
Figure 5:
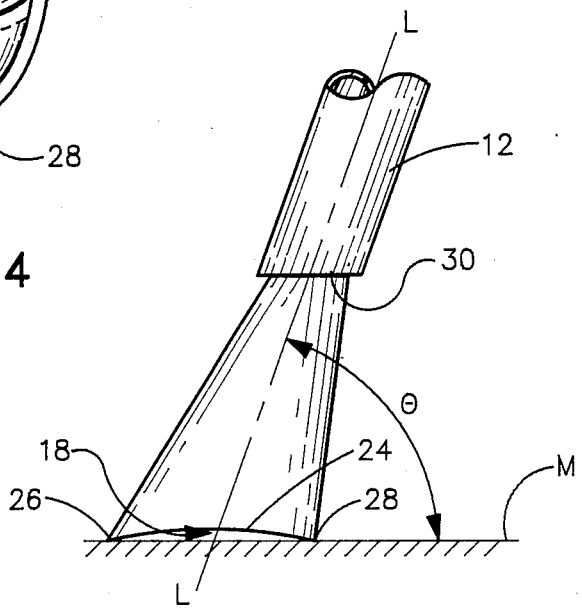
FIG. 5 shows the nozzle structure of FIG. 2 in a side view in elevation and in an operative position on a support surface.

As is best shown in FIGS. 3 and 4, nozzle 14 is formed by a pair of generally flattened side walls 34 and 36 and a pair of curved edge walls 38 and 40 that contain extrema 26 and 28, respectively. Furthermore, as is seen in FIG. 2, the surrounding wall of nozzle 14 tapers outwardly from edge 30 of handle 12 to terminate at upstream rim 24. In use, as is shown in FIG. 5, extrema 26 and 28 define contact points on surface M, which may correspond to a bottom or side wall of the spa, and longitudinal axis L is then oriented at angle $\theta$ with respect to surface M. Furthermore, inlet 18, because of its concavity, arches away from surface M so that fluid may flow into inlet 18 when extrema 26 and 28 of rim 24 contacts surface M. Since end 30 of handle 12 is canted at angle $\theta$ with respect to axis L, edge 30 is generally parallel to surface M during use.

Figure 6:
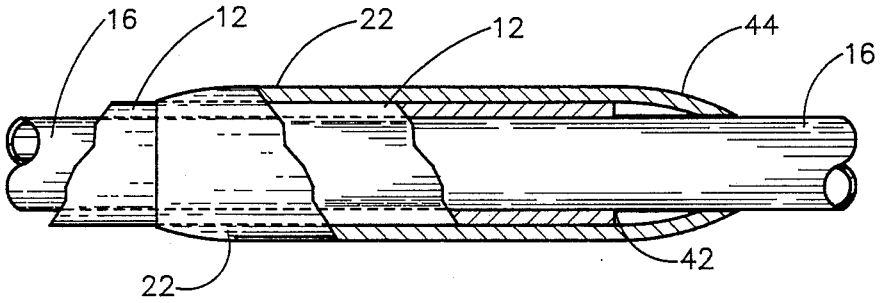
FIG. 6 is a side view and partial cross section of the downstream end of the handle of the siphon device shown in FIG. 1, with this figure showing the hose, the downstream end of the handle and the protector sleeve, all according to the preferred embodiment of the present invention.

In a preferred form of the present invention, nozzle 14 and hose 16 are formed of an integral tubular member. As is seen in FIGS. 2, 3 and 6, hose 16 extends completely through handle 12 with handle 12 being a relatively rigid thermoplastic tube having an inside diameter that is the same as the outside diameter of hose 16. Nozzle 14 is constructed by deforming the upstream end of hose 16 into the shape described above. Where hose 16 is constructed of a flexible thermoplastic material, this may be accomplished by heating the thermoplastic material and conforming nozzle 14 by the use of a mold and cooling the nozzle so that the upstream end of hose 16 retains the nozzle shape. Nozzle 14 has a pliable and resilient construction since it is formed out of the flexible thermoplastic material. To allow the telescopic insertion of hose 16 into handle 12, the outer surface of hose 16 is lubricated by an evaporative lubricant so that hose 16 may be slid through the interior of handle 12 after which the lubricant may evaporate. Thus, handle 12 is frictionally secured on hose 16 so that upstream edge 30 is immediately adjacent to nozzle 14 with handle 12 terminating in a downstream edge 42, opposite edge 30.

As is shown in FIG. 6, protector sleeve 22 telescopically receives an end portion of handle 12 and overlaps downstream edge 42 so that an end portion 44 of sleeve 22 extends around hose 16. Sleeve 22 is formed of any suitable plastic material, as is known in the art, and may preferably be a heat shrinking material so that it may be positioned around the end portion of handle 12 and hose 16 and shrunk so that it conforms to the shape thereof. End portion 44 acts as a protecting means to prevent mechanical fatigue of hose 16 as it flexes against edge 42 of handle 12.

In operation, the user immerses siphon device 10, including a sufficient amount of hose 16, so that siphon device 10 is substantially filled with fluid from the spa or other fluid holding container. Discharge outlet 20 of hose 16 is then positioned in a desired waste location that is at a lower gravitational potential than the surface of fluid in the spa while nozzle 14 remains immersed therein. After the fluid starts to siphon out of the spa, the user may advance inlet 18 along the surface M to be cleaned, thereby removing particulate debris, such as sand, small pebbles and the like, as the fluid flows out of the spa to the waste location. It should be appreciated that this invention accomplishes the objects set forth by removing only a small amount of the fluid along with the particulate debris. Further, it should be appreciated from the foregoing, that the construction of nozzle 14 as a deformed portion of hose 16 reduces manufacturing costs to provide a simple yet effective siphon device 10 that is very durable in use since there are no threaded couplings, specialized connection elements, or the like.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A siphon device adapted to remove particulate debris from a spa by utilizing siphoned liquid to convey the debris out of the spa, as the liquid flows to a waste location, comprising:

an elongated, relatively rigid tubular handle having a longitudinal passageway operative to convey liquid from an upstream end to a downstream end thereof;

a nozzle having a surrounding sidewall defining a nozzle outlet in fluid communication with said passageway at the upstream end of said handle and having an ovoid nozzle inlet formed by a rim of said nozzle at an upstream end thereof, said rim being contiguous on an imaginary concave surface with respect to said nozzle, said nozzle being formed of a pliable material; and a flexible hose having a hose inlet in fluid communication with said passageway at the downstream end of said handle and having a discharge outlet opposite said hose inlet whereby liquid may flow into said nozzle, through said passageway and said hose and be discharged at said waste location.

2. A siphon device according to claim 1 wherein said concave surface is canted at an acute angle with respect to the longitudinal axis of said handle.

3. A siphon device according to claim 2 wherein said acute angle is between 60° and 80°.

4. A siphon device according to claim 1 wherein said hose and said nozzle are formed as an integral piece of flexible tubing having a selected outside diameter, one end of said piece beng deformed and configured into said nozzle and the other end of said piece defining said discharge outlet, said handle being an elongated rigid tubular element having an inside diameter the same as the outside diameter of said piece of flexible tubing, said flexible tubing extending completely through said elongated rigid tubular element.

5. A siphon device according to claim 4 wherein said concave surface is canted at an acute angle with respect to the longitudinal axis of said handle and an upstream end of said tubular element is formed in a plane canted equiangularly to the longitudinal axis as said concave surface.

6. A siphon device according to claim 4 including a sleeve covering the downstream edge of said handle whereby a first sleeve portion extends around a downstream end portion of said handle and whereby a second sleeve portion extends around said hose just downstream of said downstream end of the handle and operative to retard mechanical fatigue of said hose at said downstream end.

7. A siphon device adapted to remove particulate debris from a spa by utilizing siphoned liquid to convey the debris out of the spa as the liquid flows to a waste location, comprising a flexible hose having preselected inside and outside diameters and having an upstream end for insertion into said liquid and a downstream end adapted to be positioned at the waste location located at a lower gravitational potential location than said upstream end, said upstream end being deformed into a frustoconical nozzle having a flexible yet resilient surrounding wall formed by a pair of generally flattened side walls and a pair of curved edge walls interconnecting said side walls, said surrounding wall tapering outwardly to terminate in an upstream rim defining a generally ovoid inlet, and a generally rigid elongated tubular handle receiving a portion of said hose whereby said hose extends completely through said rigid elongated tubular handle, said handle having an inside diameter substantially the same as the outside diameter of said hose and having an upstream end adjacent said nozzle, said rigid handle operative to permit manual maneuvering of said nozzle.

8. A siphon device according to claim 7 wherein said inlet is canted at an acute angle with respect to the longitudinal axis of the hose portion received in said handle.

9. A siphon device according to claim 8 wherein said upstream end of said handle is formed at an angle so that it is generally parallel to said inlet.

10. A siphon device according to claim 7 wherein said inlet is concave with respect to said nozzle whereby said rim defines a pair of opposite contact points when said inlet is placed on a flat surface to be cleaned, said inlet being arcuate between said contact points.

11. A siphon device according to claim 10 wherein the radius of curvature of said inlet is approximately four to eight times the distance between said contact points.

12. A siphon device according to claim 7 including a protector sleeve covering a downstream end portion of said handle on a portion of said hose immediately downstream of said downstream end portion, said protector sleeve operative to reduce mechanical fatigue of said hose at a downstream end of said handle.

13. A siphon device according to claim 7 wherein said hose is constructed of flexible thermoplastic and said handle is constructed of rigid thermoplastic.

* * * * *